US007275648B2

(12) United States Patent
Segovia, Jr.

(10) Patent No.: US 7,275,648 B2
(45) Date of Patent: Oct. 2, 2007

(54) EASY STUD RACK

(75) Inventor: Eugenio Segovia, Jr., Bellville, TX (US)

(73) Assignee: Simple Innovations, L.L.C., Belville, TX (US)

( * ) Notice: Subject to any disclaimer, the term of this patent is extended or adjusted under 35 U.S.C. 154(b) by 0 days.

(21) Appl. No.: 11/506,705

(22) Filed: Aug. 19, 2006

(65) Prior Publication Data

US 2006/0278595 A1 Dec. 14, 2006

Related U.S. Application Data

(63) Continuation-in-part of application No. 11/049,837, filed on Feb. 3, 2005, now abandoned.

(60) Provisional application No. 60/541,658, filed on Feb. 4, 2004.

(51) Int. Cl.
*A47F 5/00* (2006.01)

(52) U.S. Cl. ..... 211/134; 211/189; 211/208; 211/87.01; 211/187; 108/42; 248/235

(58) Field of Classification Search ..... 211/134, 211/189, 175, 195, 41.1, 87.01, 207, 90.01, 211/187, 153, 190, 208, 85.7; 108/42, 152, 108/59, 157.13, 144.11, 235, 274.1, 226.11, 108/205.1, 200; 248/235, 274.1, 226.11, 248/205.1, 200; 312/252; D08/354
See application file for complete search history.

(56) References Cited

U.S. PATENT DOCUMENTS

| | | | | |
|---|---|---|---|---|
| 597,186 | A * | 1/1898 | Hunter | 108/110 |
| 810,545 | A | 1/1906 | Krag et al. | |
| 1,059,464 | A | 4/1913 | Hine | |
| 1,621,327 | A | 3/1927 | Lehman | |
| 1,630,105 | A | 5/1927 | Bernard | |
| 2,346,430 | A | 4/1944 | Hauser | |
| 3,271,626 | A | 9/1966 | Howrilka | |
| 4,501,368 | A | 2/1985 | Gill | |
| 4,762,689 | A * | 8/1988 | Frey et al. | 422/310 |
| 4,804,094 | A * | 2/1989 | Eittreim | 211/88.01 |
| 5,127,340 | A | 7/1992 | Maro et al. | |
| 5,259,668 | A | 11/1993 | Teufel et al. | |
| 5,393,135 | A * | 2/1995 | Tisbo et al. | 312/9.48 |
| D364,512 | S | 11/1995 | Stravitz | |
| 5,612,797 | A * | 3/1997 | Clarke | 349/5 |
| 5,617,797 | A | 4/1997 | Casey | |
| D381,236 | S * | 7/1997 | Stravitz | D6/630 |
| 5,921,190 | A * | 7/1999 | Wood | 108/108 |
| 6,062,401 | A | 5/2000 | Hall et al. | |
| 6,202,570 | B1 * | 3/2001 | Kurtsman | 108/108 |
| 6,205,934 | B1 * | 3/2001 | Felton et al. | 108/107 |
| 6,340,086 | B1 * | 1/2002 | McConnaughy et al. | 206/307.1 |

(Continued)

*Primary Examiner*—Richard E. Chilcot, Jr.
*Assistant Examiner*—Lindsay M. Maguire
(74) *Attorney, Agent, or Firm*—Kurt J. Myers

(57) ABSTRACT

A single formed rack of rectangular shape with a length substantially greater than its width is attached to a stud, the rack having a plurality of raised sections defining spaced unobstructed slots across its width, each slot having a hole therein for attaching the rack by nails or screws to the stud. To provide the racking system, a second rack is attached to an adjacent stud and the slots of the two racks are aligned horizontally between the two studs. One or more boards may be inserted into the horizontally opposing unobstructed slots.

9 Claims, 12 Drawing Sheets

U.S. PATENT DOCUMENTS

| | | | | |
|---|---|---|---|---|
| 6,446,817 | B1 | 9/2002 | Stitt | |
| 6,675,725 | B2 * | 1/2004 | Felton et al. | 108/107 |
| 6,796,248 | B1 * | 9/2004 | Dressendorfer et al. | 108/110 |
| 6,940,730 | B1 | 9/2005 | Berg et al. | |
| 6,948,623 | B2 * | 9/2005 | Takano | 211/41.1 |
| 2002/0172012 | A1 | 11/2002 | Chandler | |
| 2003/0010735 | A1 | 1/2003 | Wuerth | |
| 2003/0099580 | A1 | 5/2003 | Pressman et al. | |
| 2003/0121874 | A1 | 7/2003 | Koester et al. | |
| 2004/0020881 | A1 | 2/2004 | Wuerth | |

* cited by examiner

EASY STUD RACK

RELATED APPLICATION

This application is a Continuation-in-Part application of U.S. Ser. No. 11/049,837, filed Feb. 3, 2005 now abandoned, entitled Easy Stud Rack, which is based on Provisional Application No. 60/541,658, filed Feb. 4, 2004, entitled Easy Stud Rack, both of which are incorporated herein by reference.

FIELD OF THE INVENTION

The present invention is directed to a racking system for utilizing the space between studs in a home, garage, or business.

BACKGROUND OF THE INVENTION

U.S. Pat. No. 5,617,797 discloses shelving for installation between studs that extends beyond the front edges of the studs, and require spikes or screws to support the shelves during installation.

U.S. Pat. No. 5,921,190 discloses a modular display system including partitions with readily engageable shelves, hangers, media and display boards and the like.

U.S. Pat. No. 6,202,570 discloses a communication equipment relay rack. The rack comprises a pair of spaced parallel upright columns. A mounting ear is secured to each upright column at a selected height on the respective column.

U.S. Pat. Nos. 6,205,934 and 6,675,725 both discloses many embodiments of a support and related shelf.

SUMMARY OF THE INVENTION

The present invention is directed to a molded rack characterized by having a rectangular shape with a length substantially greater than its width and having raised sections defining spaced slots across its width. Holes are provided in the slots that are of a size and shape to attach the rack to a stud by a nail or screw having a head. A racking system has two molded racks on opposing studs in a wooden structure such as a garage. More specifically, by aligning the racks horizontally on adjacent studs, one or more shelves may be inserted into the horizontally opposing slots. The shelves are readily adjustable.

DESCRIPTION OF THE PREFERRED EMBODIMENTS OF THE PRESENT INVENTION

Figure 1:
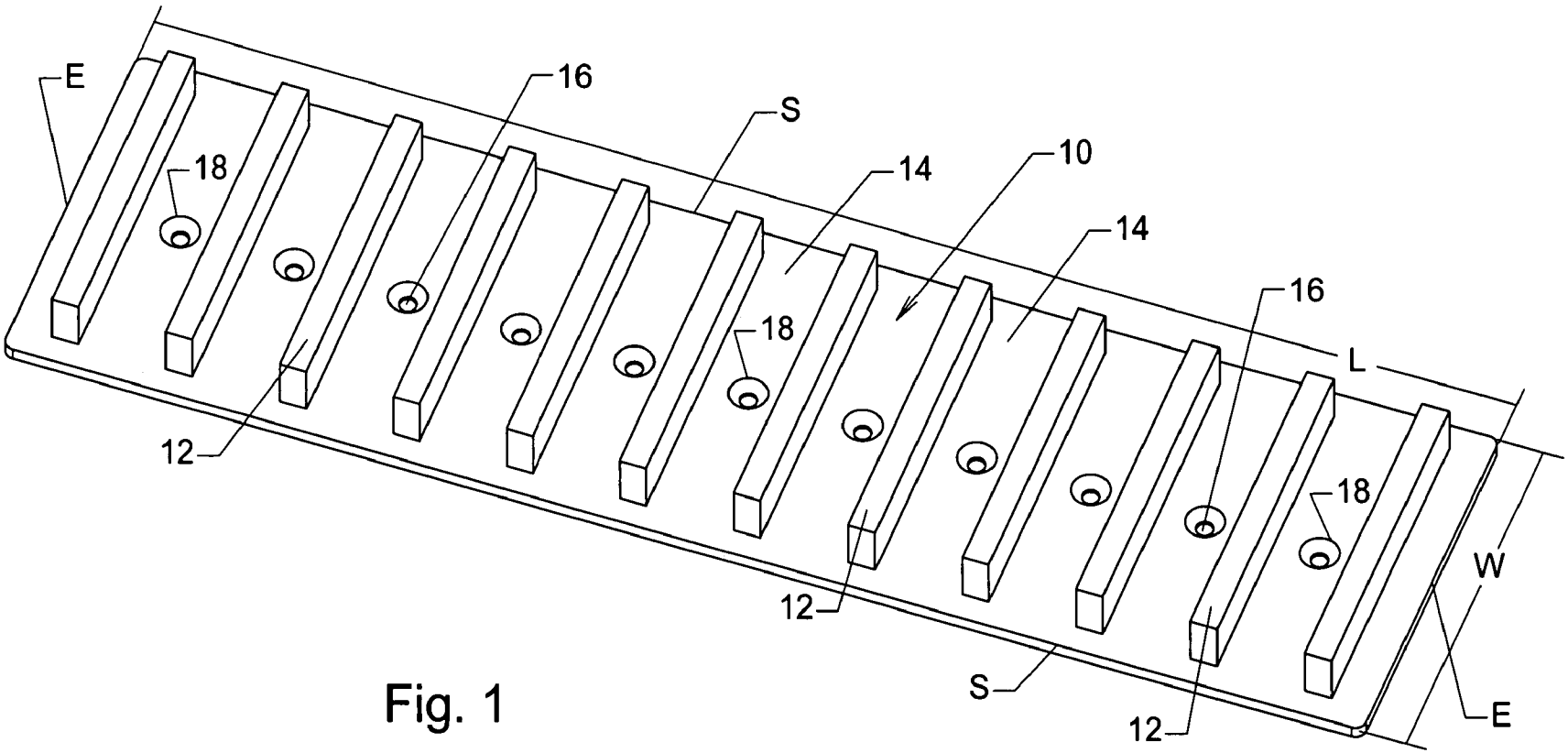
FIG. 1 is an isometric view of a rack of the present invention.

Referring to FIG. 1, a rack 10 of the present invention is shown. Rack 10 is preferably a formed rack of molded plastic such as polypropylene; however, other materials may be used. Rack 10 is preferably a rectangular shape, with raised sections 12 defining a plurality of equally spaced slots 14. Preferably there are at least two holes 16 of a size and shape for attaching the rack 10 by nails or screws to a stud. Another feature illustrated in FIG. 1 is that each hole 16 may be countersunk, as shown by 18, so that the head of the nail or screw does not interfere with the shelving inserted in the slot.

Figure 2:
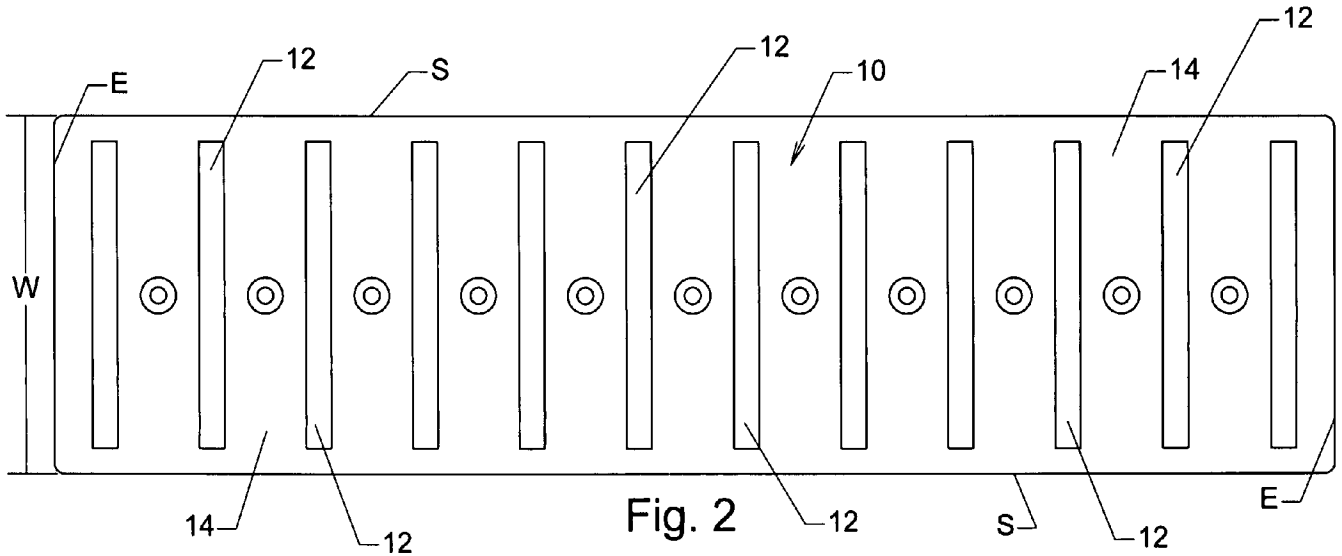
FIG. 2 is a top view of the rack of FIG. 1.
Figure 3:
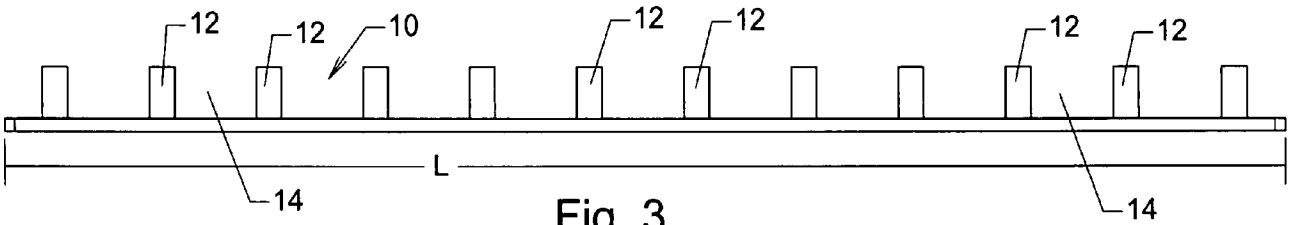
FIG. 3 is a side view of the rack of FIG. 1.

Referring now to FIGS. 2 and 3, preferably the rack 10 has two sides (S) and two ends (E). The width (W) of rack 10 is less than the 4 inch dimension of a standard 2×4 stud. The length (L) of the sides of rack 10 may be from about 6 inches to about 8 feet. Raised sections 12 are spaced parallel to the ends (E) or across the width of rack 10 and at equally spaced distances to define slots 14 of about 13/16 inches in height. The raised sections 12 extend from the base of rack 10 as defined by the sides (S) and ends (E).

Figure 4:
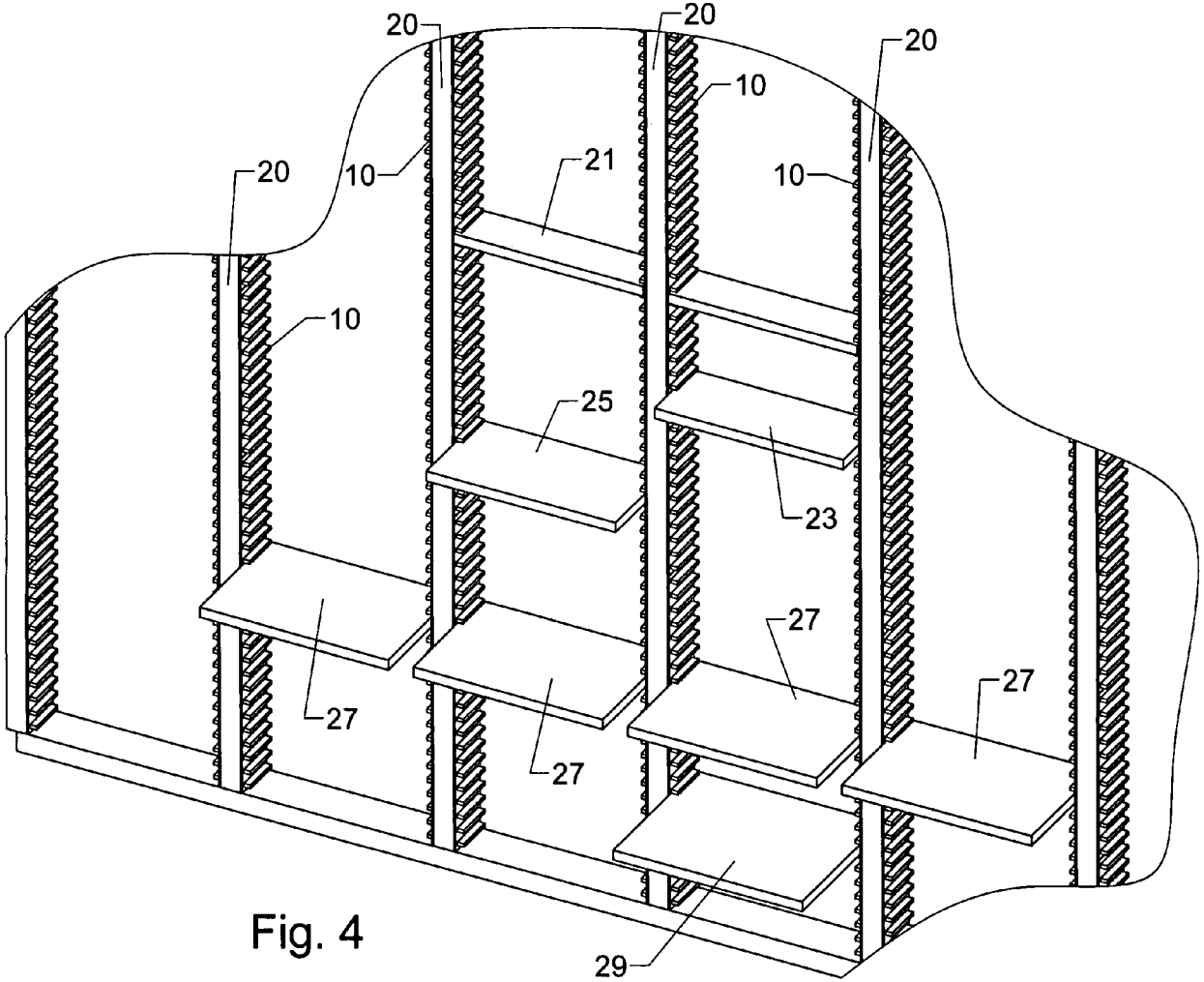
FIG. 4 illustrates one racking system of the present invention, with opposing racks on opposing studs and a variety of shelves arranged at a variety of levels.
Figure 5:
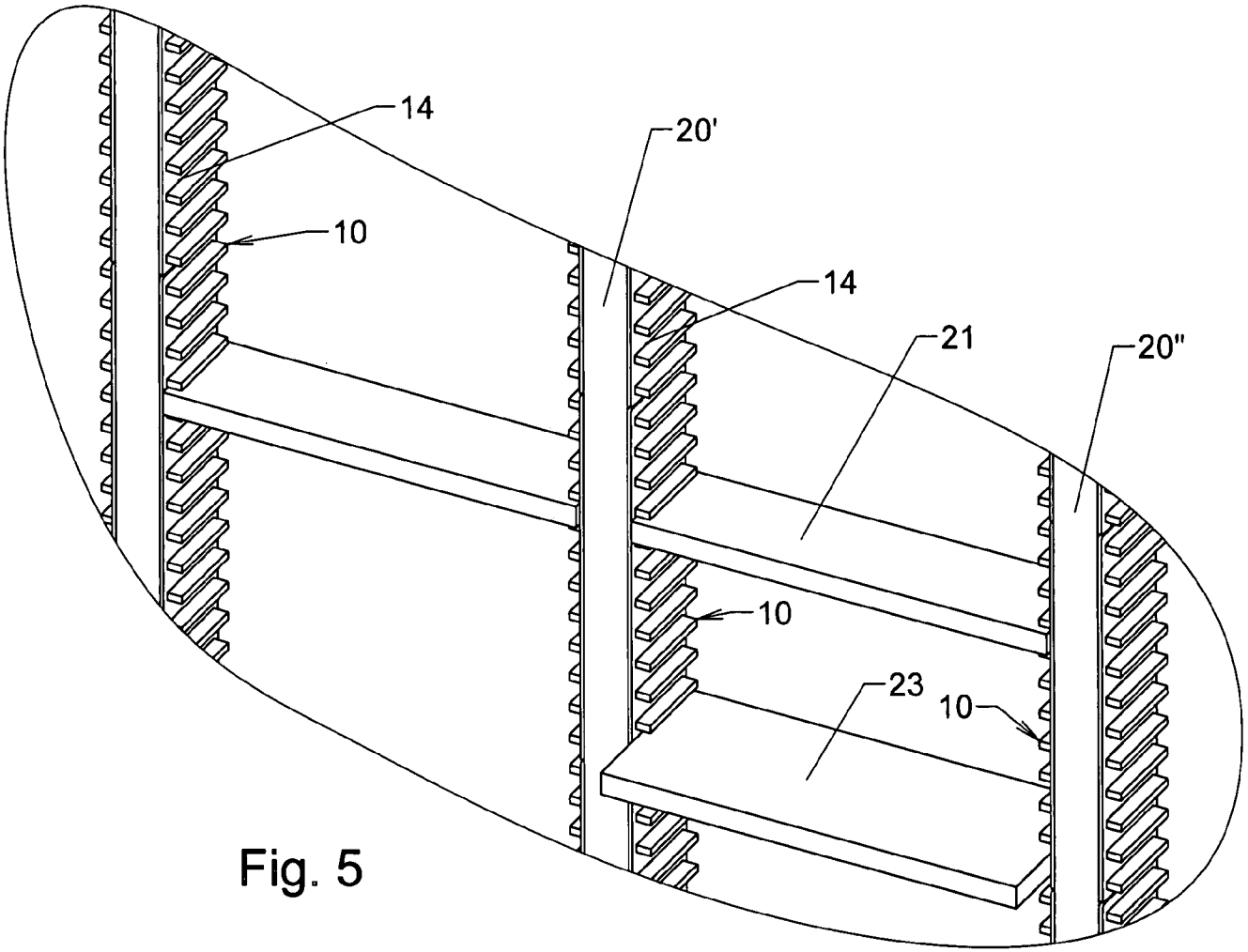
FIG. 5 is a magnified view of the system of FIG. 4 of the present invention.

FIGS. 4 and 5 illustrate a racking system of the present invention. Two racks 10 are mounted on opposing studs 20, meaning on one side of one stud 20' and the opposite side of the next stud 20" (FIG. 5). The slots or spaces 14 (FIG. 5) are made to accept existing 1×4 (21), 1×6 (23), 1×8 (25), 1×10 (27) or 1×12 (29) boards cut to the correct length. The flexibility of the system of the present invention allows one to select shelves for an entire garage wall that has not been sheet rocked, without requiring the shelves to be nailed or screwed into a fixed location. As needs change the boards may be rearranged or boards of larger or smaller size may be used or more or less boards used on the wall. Also as illustrated by the 1×10 boards (27) that extend beyond the studs, the boards may be aligned in slots 14 at the same horizontal level and the extending surfaces provide a surface for long items, e.g. fishing poles and the like. By removing existing shelves and sheet rock (exposing studs), pantries or closets may employ the racking system of the present invention to minimize wasted space.

Figure 6:
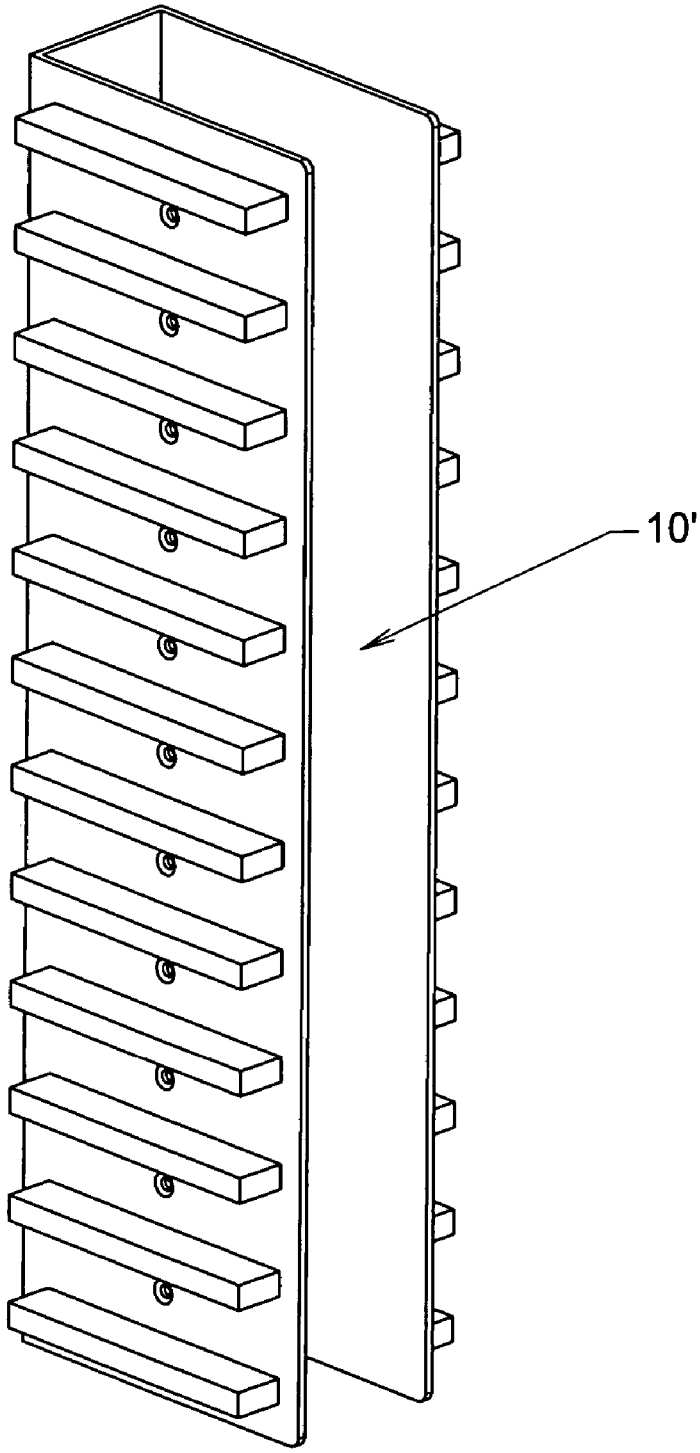
FIG. 6 is an isometric view of another embodiment of a rack of the present invention.
Figure 7:
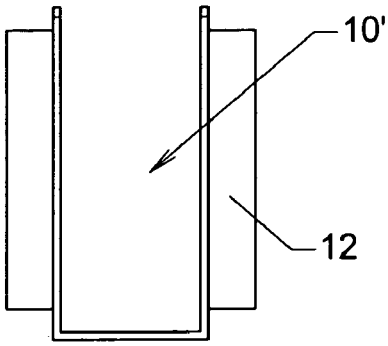
FIG. 7 is an end view of the rack of FIG. 6, showing the U shape of this embodiment.
Figure 8:
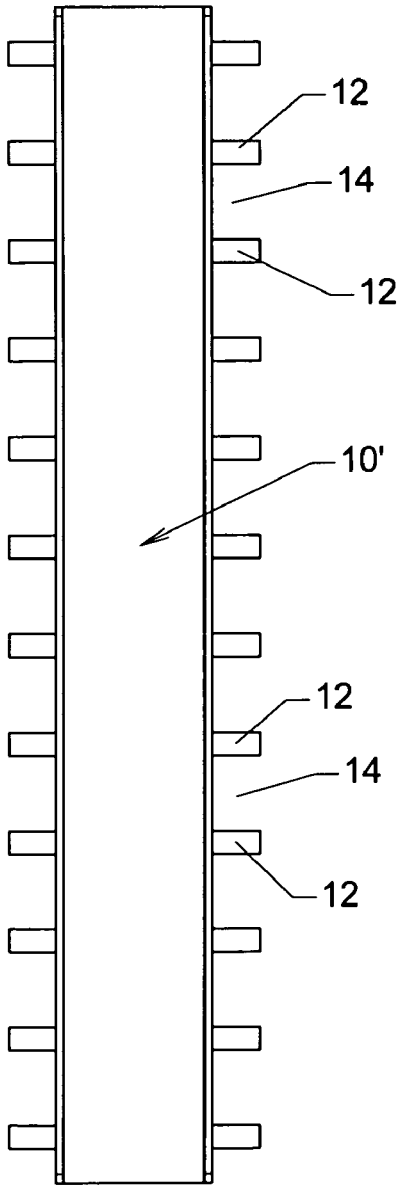
FIG. 8 is a side view of the rack of FIG. 6.

Referring now to FIG. 6, a second embodiment of the present invention is shown in rack 10'. Rack 10' is U shaped (see FIG. 7); however, the parallel surfaces, of rectangular shape, have raised sections 12 defining a plurality of equally spaced slots 14. The U shape allows the rack 10' to slide over a stud. When two adjacent studs have racks 10' installed, essentially the same racking system is provided as that using racks 10.

Figure 9:
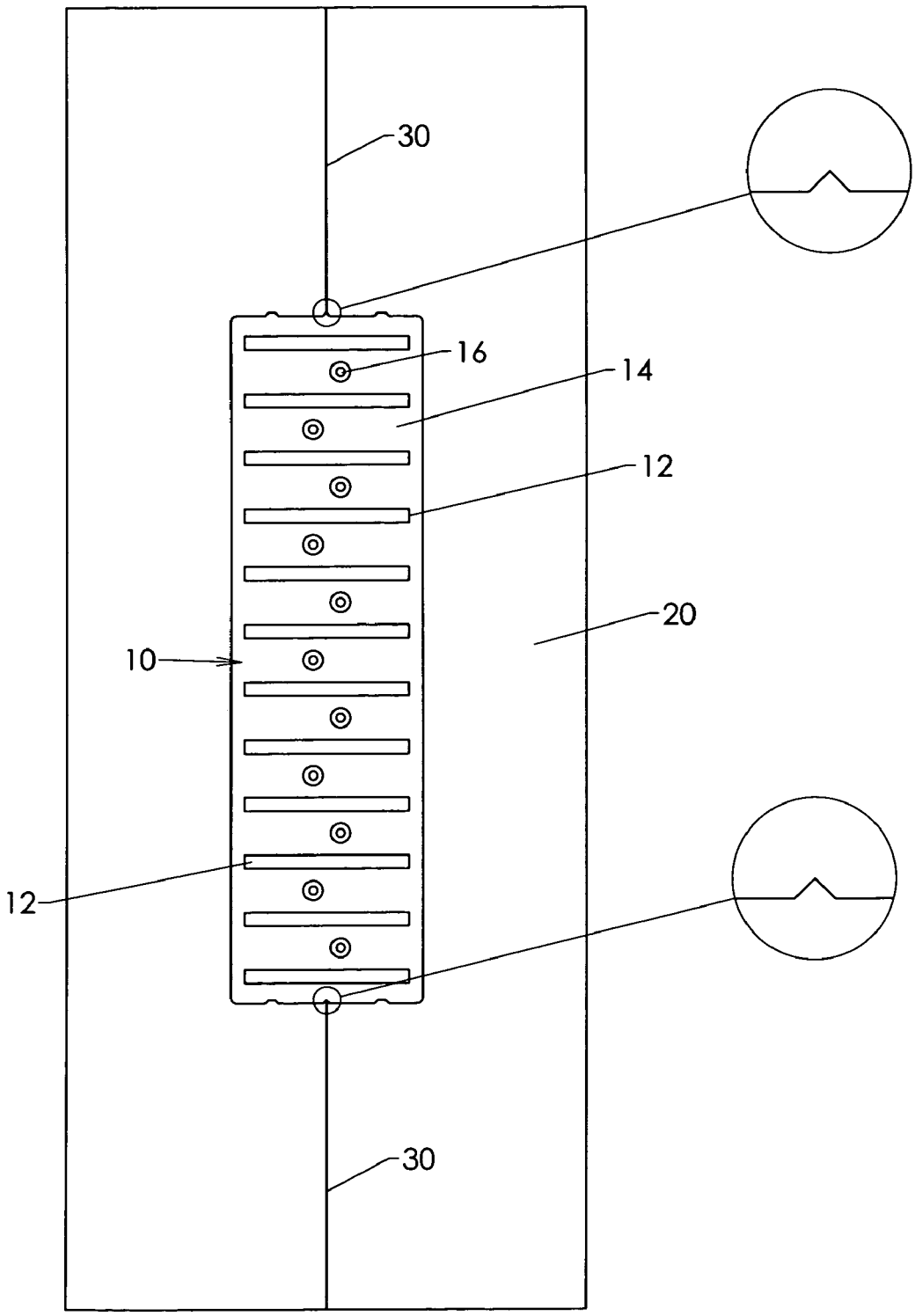
FIG. 9 is a top view of a preferred embodiment of the present invention where the holes are within the spaced slots, each slot having a hole therein that is offset to the vertical center of said rack.
Figure 10:
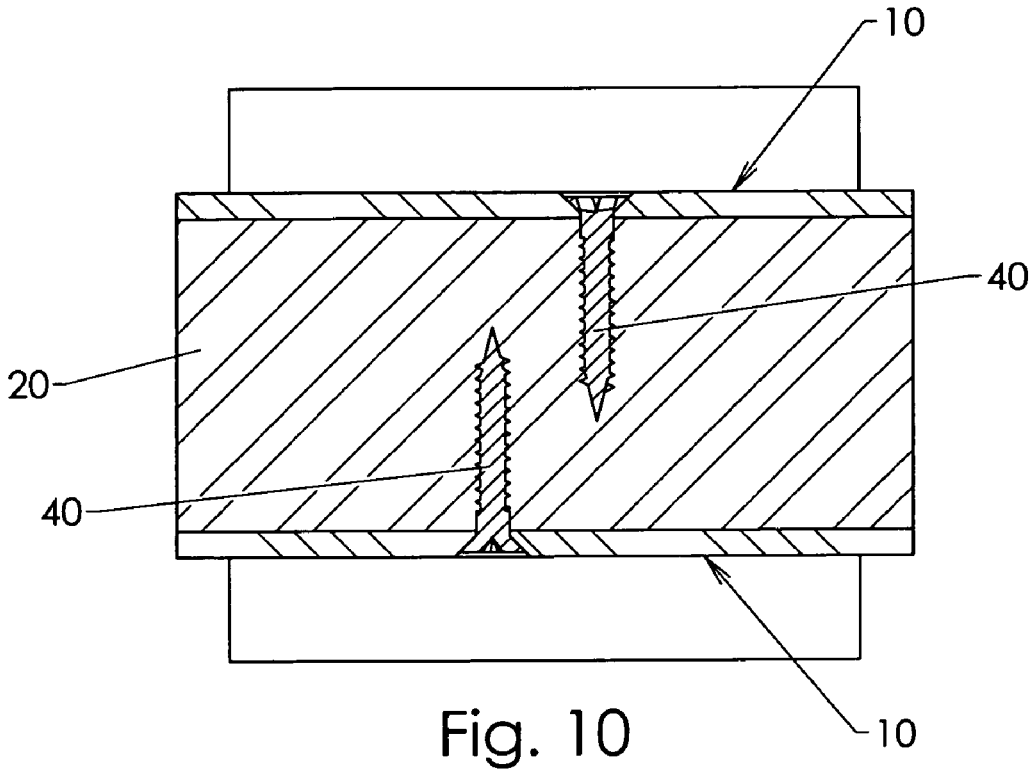
FIG. 10 is a cross-sectional view of a stud having the rack of FIG. 9 on both sides of the stud.

Referring now to FIG. 9, the rack 10 of this preferred embodiment of the present invention has each hole 16 within the spaced slots 14 offset to the vertical center of said rack. This feature is shown by the placing of the rack 10 on a stud 20 with a marked line 30 to center the rack 10 upon installation. The advantage of the holes 16 being offset is illustrated in FIG. 10 which illustrates that when the rack 10 is placed in the same relative position on opposite sides of the stud 20 that the screws 40 or nails are offset and will not interfere with each other.

Figure 11:
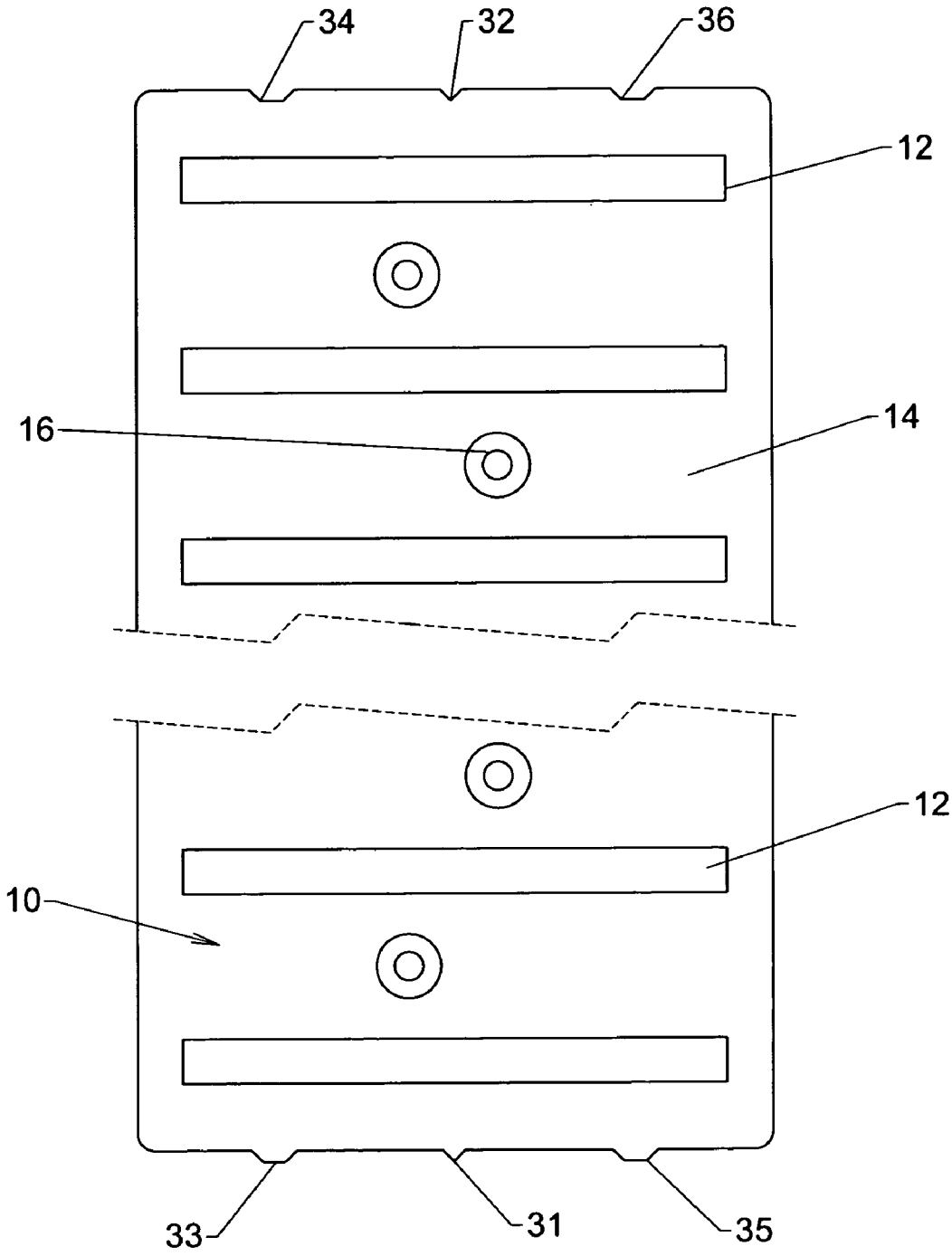
FIG. 11 is a top view of the rack of FIG. 9 with details of the top and bottom edge of the rack enlarged to illustrate an added feature or modification that may be made to the racks of the present invention.
Figure 12:
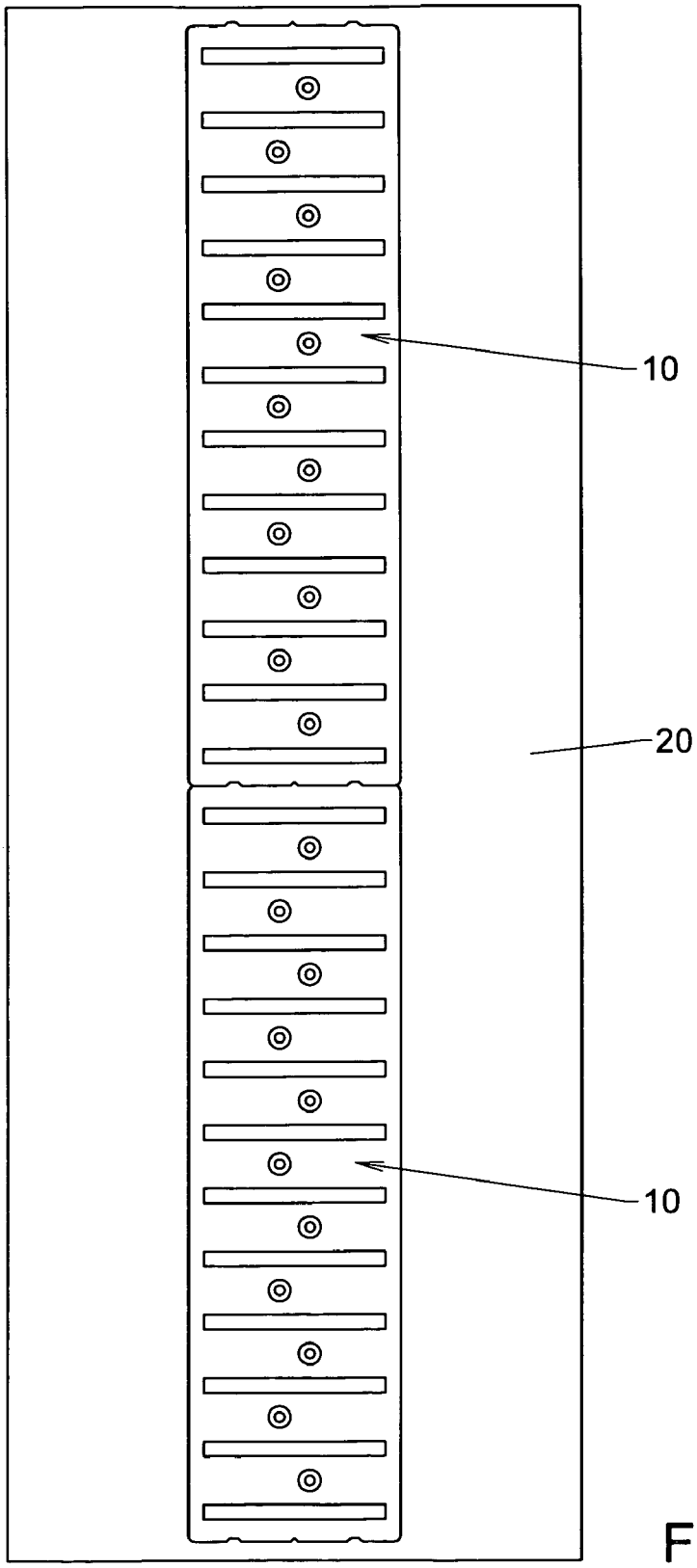
FIG. 12 is a top view of two racks utilizing the modifications of FIG. 11 to align the racks.

In FIGS. 11 and 12, an added feature or modification of any of the embodiments of the racks of the present invention is illustrated. FIG. 11 illustrates a male alignment guide 31 and a female alignment guide 32 at the vertical center of the opposite edges of the rack 10. Each alignment guide has the same corresponding shape, such as a small triangle. More than one alignment guide may be on each edge as illustrated by corresponding guides 33 and 34 or 35 and 36. The advantage of the alignment guide is illustrated in FIG. 12 where two racks 10 are mounted to a stud.

Figure 14:
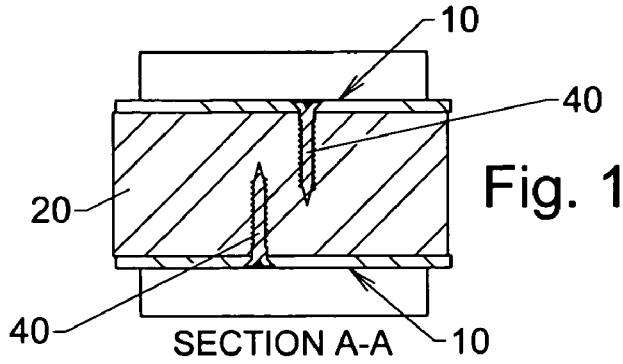
FIG. 14 is a cross-sectional view of a stud along cross-section A-A of FIG. 13 having the rack of FIG. 13 on both sides of the stud.
Figure 13:
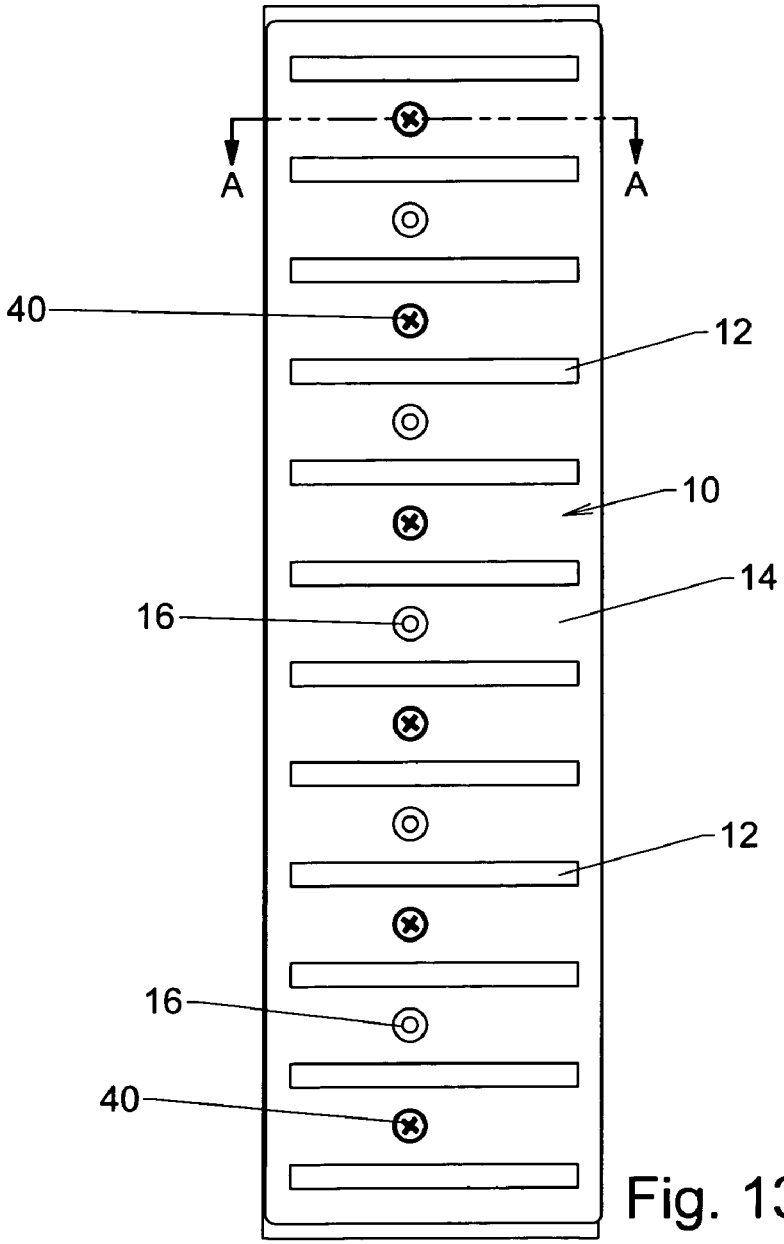
FIG. 13 is a top view of another embodiment of a rack of the present invention.

Referring now to FIG. 13, another embodiment of a rack 10 of the present invention is shown, illustrating that the holes 16 may be off center to the vertical center of rack 10 in a manner different than that shown in FIG. 9. FIG. 14 shows the advantage of the off center holes in the cross-section A-A wherein the screws 40 or nails of two racks 10 when applied to the stud 20 have no interference.

The above description of the present invention is not limited to the dimensions or to requiring 2×4 studs. For example, the system may be manufactured to accept thinner boards, e.g. plywood, for lighter duty applications.

Figure 15:
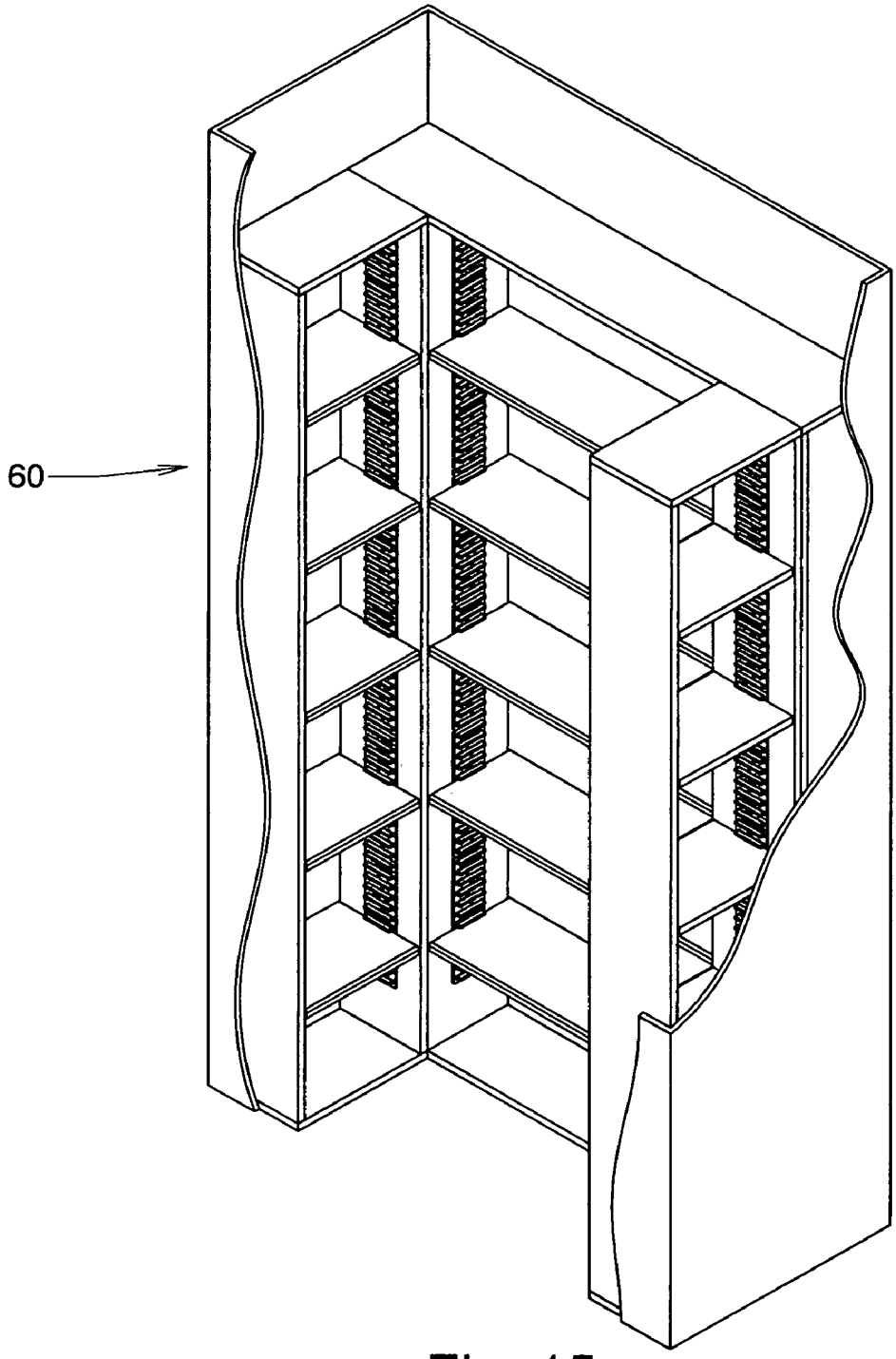
FIG. 15 is an isometric view of a pantry or closet that utilizes a racking system of the present invention to provide shelving.

To illustrate the application of the racks 10 of the present invention to provide shelving in a wide variety of situations between studs 20, other than between studs in a garage, FIG. 15 illustrates a pantry 60 or a closet that uses the racks 10 of the present invention. The studding need not be limited to 2×4 studs.

The invention claimed is:

1. A rack for a racking system for providing shelving between studs comprising:

a single solid formed rack of rectangular shape with a length substantially greater than its width and having a plurality of raised sections defining spaced unobstructed slots across its width, each slot having a hole therein that is offset to the vertical center of said rack to attach said rack by nails or screws to a stud.

2. A rack according to claim 1 wherein said width is less than 4 inches.

3. A rack according to claim 1 wherein the slots are approximately ¾ inches in height.

4. A rack according to claim 1 which is made of molded plastic.

5. A rack according to claim 4 wherein said plastic is polypropylene.

6. A rack according to claim 1 wherein said holes are countersunk.

7. A rack for a racking system for providing shelving between studs comprising: between studs comprising:

a single solid formed rack of rectangular shape with a length substantially greater than its width and having a plurality of raised sections defining spaced unobstructed slots across its width, and having a hole within each different spaced slot with a size and shape to attach said rack by nails or screws to a stud.

8. A racking system for providing shelving between two studs comprising:

a single solid molded plastic rack of rectangular shape with a length substantially greater than its width, and having a plurality of raised sections defining spaced unobstructed slots across its width mounted on one stud face; and a second single solid molded plastic rack of rectangular shape with a length substantially greater than its width and having a plurality of raised sections defining spaced unobstructed slots across its width mounted on the opposing face of the next stud;

each of said racks having a countersunk hole in each of the spaced slots.

9. A rack for a racking system to be slid over a stud for providing shelving between studs comprising:

a single solid U-shaped rack having two spaced parallel surfaces of rectangular shape with a length substantially greater than its width and having a each parallel surface, each slot having a hole therein to attach said rack by nails or screws to said stud.

* * * * *